United States Patent [19]

Lile

[11] 4,424,998

[45] Jan. 10, 1984

[54] CLOTH DOLL STUFFING TOOL

[76] Inventor: Cecilia Lile, 2415 W. 46th St., Chicago, Ill. 60632

[21] Appl. No.: 293,946

[22] Filed: Aug. 18, 1981

[51] Int. Cl.[3] ..... B25B 7/00

[52] U.S. Cl. ..... 294/118; 81/5.1 R; 128/321

[58] Field of Search ..... 294/1 R, 8.5, 11, 16, 294/28, 31 R, 118, 106, DIG. 2; 29/278, 805; 81/5.1 R, 8.1, 43; 128/321, 322, 346, 354, 355

[56] References Cited

U.S. PATENT DOCUMENTS

| | | | |
|---|---|---|---|
| 57,431 | 8/1866 | Yerkes . | |
| 474,130 | 5/1892 | Henger | 128/322 |
| 1,327,577 | 1/1920 | Turner . | |
| 1,356,048 | 10/1920 | Dederer | 128/322 |
| 1,471,531 | 10/1923 | Schorrath . | |
| 1,745,411 | 2/1930 | Fay | 81/5.1 R X |
| 1,806,808 | 5/1931 | Lahey | 128/322 |
| 1,936,981 | 11/1933 | Houghton . | |
| 2,478,595 | 8/1949 | Richter . | |
| 2,644,455 | 7/1953 | Benoit . | |
| 2,704,399 | 3/1955 | Melcher | 128/321 X |
| 2,743,726 | 5/1956 | Grieshaber | 294/118 X |
| 2,796,065 | 6/1957 | Kapp | 128/346 |
| 3,101,715 | 8/1963 | Glassman . | |
| 3,349,772 | 10/1967 | Rygg . | |
| 3,807,406 | 4/1974 | Rafferty et al. . | |
| 3,911,925 | 10/1975 | Tillery, Jr. . | |

*Primary Examiner*—Johnny D. Cherry
*Attorney, Agent, or Firm*—Keil & Witherspoon

[57] ABSTRACT

A tool for reaching into the confined sections of cloth dolls or similar constructions, which can grasp the doll fabric for turning the doll inside out and which can grasp stuffing material for insertion within the doll. The tool comprises two pivotally joined members, each having a finger guide, a long, thin shank, and an opposing jaw. The inner face of at least one jaw may contain surface irregularities along the midline or the jaw face, to facilitate grasping while maintaining a smooth edge around the borders of the jaw.

1 Claim, 6 Drawing Figures

CLOTH DOLL STUFFING TOOL

BACKGROUND OF THE INVENTION

This invention relates generally to the sewing art, are particularly to a tool for reaching into the confined places in cloth dolls which is able to grasp the doll fabric for turning the doll inside out and which also is able to grasp filler material for placement into these confined areas.

In the practice of making cloth dolls, and similar items, the doll is first sewn together with what is to be the outer surface on the inside. After the pieces of the doll are sewn together, the doll is turned inside out, or reversed, and stuffed with filling material through an opening left in the seam. After stuffing is completed the opening is sewn together to finish the doll.

Two difficult steps are encountered in making these dolls. First, there are problems turning the narrow areas of the doll, such as the appendages, inside out because of the difficulty in reaching into these confined spaces. Second, after the doll is reversed, so that the finished surface is on the outside, it is difficult to stuff these confined areas with filling material to produce a finished doll which is both evenly and adequately stuffed.

Heretofore the reversing of the confined sections and their filling has been performed by hand-pushing the doll material right side out by uing a dowel or pencil or screwdriver. Stuffing the doll a little bit at a time and pushing the stuffing down with a dowel. The use of rod-like objects to poke and prod stuffing into these sections has also caused problems by producing a finished doll which is not evenly filled and has, therefore, a lumpy and uneven feel and appearance.

An additional problem encountered in using rod like devices in making cloth dolls is that these implements have sharp ends or edges which easily tear the doll fabric when reversing or stuffing the doll.

SUMMARY OF THE INVENTION

It is the object of the present invention to provide a tool which can reach into the confined areas of a cloth doll and grasp the cloth to facilitate turning the doll inside out.

It is a further object of the present invention to provide a tool which can reach into the confined areas of a cloth doll and place filling material of the desired amount into the specific locations to achieve an adequate and even filling.

A third object of this invention is to provide a tool for reversing and stuffing these dolls which is without sharp edges and tips, enabling the tool to be used without tearing the doll fabric.

These and other objects are achieved according to the present invention by providing a tool which is in the form of a long and narrow device having finger guides, straight shanks, jaws with flat inner surfaces, and a smooth or rounded tip end.

The device is formed from two members, each comprising a finger guide section, a shank section and a jaw section. The two members are joined together by a screw or pin, or a similar means, at a pivot point where the jaw section becomes the shank section. The finger guides are preferably loop-like means as are commonly found in scissors, although they can be formed in other ways. The finger guides can also be, for example, open if the tool is spring loaded, such as with a spring means located between the shanks.

The overall design of the tool is such that the two members, when closed, form a long, thin device, with the two members touching.

The inner touching surfaces of the jaws, at least at their outermost ends, comprise flat surfaces. These surfaces may be patterned with irregularities, such as grooves, which facilitate grasping the fabric and the filling material. The tip of the tool at the jaw end is of a rounded or smooth form which will not tear the doll fabric. It is important that the present invention have rounded and smooth edges on surfaces which contact the doll fabric. The patterned irregularities of the inner touching surfaces should not present sharp edges which could tear the doll fabric. A possible design feature is to have the pattern confined to an area adjacent to the midline of the inner touching surfaces.

With the tool, according to the present invention, the confined inner sections can be reached in cloth dolls or similar pieces of handwork because of the long, straight, thin overall design. The flat surfaced jaws will grasp the fabric and the filling material particularly well, enabling work to be performed and stuffing placed in very small areas such as doll arms, legs, heads and even smaller appendages such as fingers.

DESCRIPTION OF THE PREFERRED EMBODIMENT

Figure 1:
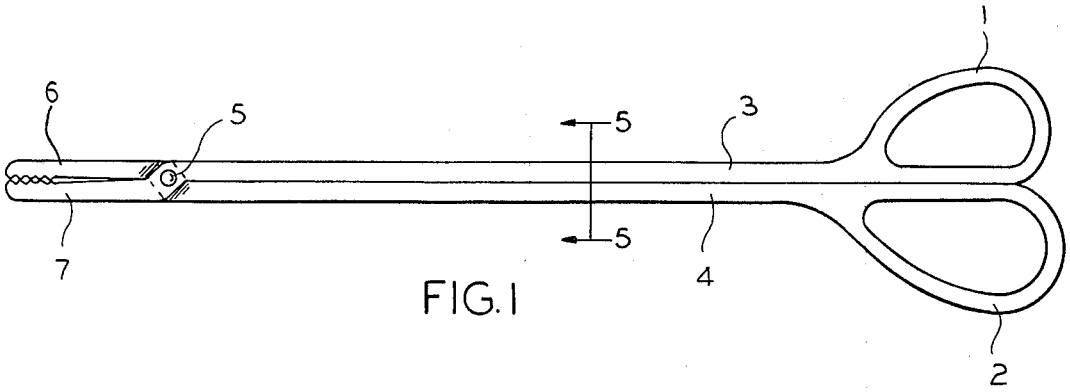
FIG. 1 is the side view of the preferred embodiment.

FIG. 1 of the drawings shows the particular character of the present invention, being two very long, thin, straight, mirror image members, arranged in a scissor fashion. Essentially all points of the mirror image members touch when the jaws are closed, presenting the smallest cross sectional profile possible.

The shank sections 3 and 4 and the jaw sections 6 and 7 are shown in FIG. 1. The pin pivot means 5 joins the two members which comprise the finger guides, the shanks and the jaws. The member which comprises the upper shank 3 crosses at the pivot 5 and becomes the lower jaw 7; the reverse being true for the lower shank 4 which crosses at 5 to become the upper jaw 6.

In the preferred embodiment the shanks, pivot and opposing jaw sections fit together when closed, the edges forming straight lines, as can be seen in FIG. 1.

Figure 2:
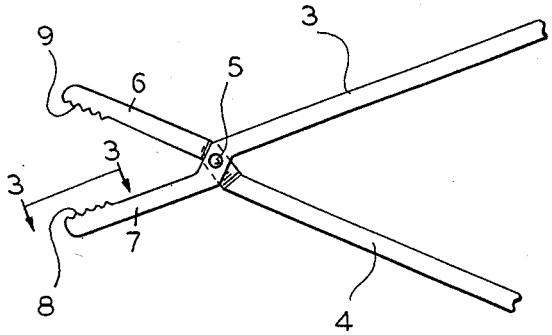
FIG. 2 is a side view of the pivot and jaws.

The pivot 5 and jaw sections 6 and 7 are shown in FIG. 2, enlarged and open. The outer ends of the jaws 6 and 7 are flat surfaces which meet when the jaws are closed and have surface irregularities 8 and 9.

Figure 3:
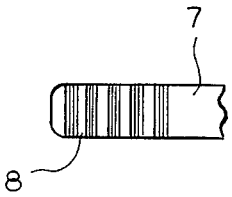
FIG. 3 shows surface irregularities, from the cutout 3—3.

Surface irregularities 8 are shown on the lower jaw 7 in FIG. 3, taken at cutout 3—3. The surface irregularities may be engraved, patterned, or other forms of irregularities. The surface irregularities 8 provide a gripping surface to better facilitate holding stuffing material in jaw sections 6 and 7.

Figure 4:
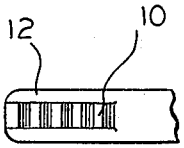
FIG. 4 shows surface irregularities confined to an area along the midline of the jaws.

FIG. 4 shows an alternate design in which surface irregularities 10 are confined to the midline of the jaws, leaving an unscored area 12 as a margin. The unscored area 12 provides isolation of the scored area 10 from the doll fabric in order to prevent pinching and tearing of the fabric.

The finger guides 1 and 2 are shown in FIG. 1 as two unequal loops as are commonly found in scissor designs. The form and relative sizes of the finger guides can be varied within the intended scope of the present invention. They can also be open curves or hooks, or even flat members with a spring located on the shank side of the pivot between the two members forcing the finger guides open.

The shanks 3,4 and opposing jaw sections 6,7 are formed to have a small cross section, the adjacent surfaces of the shank and jaw sections meeting when the device is closed, each member crossing at the pivot point to become the opposing jaw section.

Figure 5:
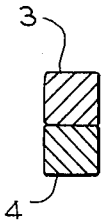
FIG. 5 shows an alternate cross section for the tool, taken at Section 5.
Figure 6:
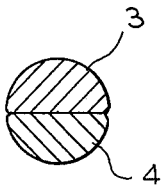
FIG. 6 shows an alternate cross section for the tool, taken at Section 5.

The members when together will have either a rectangular or circular cross section in the preferred embodiments, as shown in FIG. 5 and FIG. 6, respectively, which are taken at section 5—5.

Other cross sectional shaped members which have the outside edges of the jaw sections and shank sections preferably forming straight lines are intended to be within the scope of the present invention. It is necessary, however, that the edges, as well as the tips of the jaws, be of a relatively smooth shape to avoid tearing the doll fabric.

The tool can be made from any sufficiently rigid material which will permit the opening and closing of the jaws by manipulating the finger guides. It is preferred to make the tool from metal or a relatively rigid plastic material for reasons of manufacturing ease, cost and durability. Other materials, however, such as wood, could be used. Molding may be used in making the parts of the tool from plastic, or from other moldable material.

The members can be solid or hollow. It is envisioned that solid members will be easier to manufacture, particularly when using plastic material, although hollow tubing or other open structural designs are possible within the scope of the invention.

Lightness is a desired feature to permit easy manipulation of the tool, so that rigid plastic construction is the most preferred. However, light metals, such as aluminum, would be equally useful and possibly more durable, although being more costly.

When manufacturing the tool using metal pressed hollow tubing may be used or a composite structure, for example, hollow tubing members with solid material ends composed of metal and rigid plastic, respectively.

If desired, the tool may be wholly or partially coated or painted, or provided with padding, as for example padding the flat inside jaw surfaces or the finger guides.

The flat inside jaw surfaces may be smooth. It is preferred, however, that they are provided with a means to better grasp the fabric or filling material such as a coating or padding, or have surface irregularities thereon, for example, they may be grooved or patterned.

The preferred embodiments and drawings described above are offered as examples, but not limitations, of the invention. It is intended that modifications may be made to the invention as described in these examples while still providing a tool within the disclosure of the claims.

What is claimed is:

1. A tool for reaching into the confined sections of cloth dolls or similar constructions, having smooth or rounded edges or corners on all exposed external surfaces, which can grasp the doll fabric for turning the doll inside out and which can grasp filling material for placement within the doll, consisting essentially of:

two members joined by a pivot means; each of said members comprising a finger guide, a long thin shank extending from said finger guide to the location of said pivot means, and an opposing jaw which is shorter in length than said shank and which has a flat inner surface at its outer end, the tip of said jaw being rounded to avoid a point, the ratio of the length of the shanks to the length of the jaws being between 4:1 and 5:1; said members being long, thin and straight, and not separated at essentially all points along the lengths of said members when the tool is in the closed position; the width of the tool, in closed position, being substantially the same at all lengths of the tool except at the finger guides; and at least one jaw has surface irregularities on its inner surface which are confined along the midline of the jaw thereby leaving a smooth area of jaw surface around the border of the inner surface of said jaw, the inner surfaces of each of the jaws necessarily touching when the tool is in closed position.

* * * * *